United States Patent [19]

Newman

[11] Patent Number: 4,848,710

[45] Date of Patent: Jul. 18, 1989

[54] SUPPORT DEVICE

[76] Inventor: David A. H. Newman, 51 Gary Avenue, Hamilton, Ontario, Canada, L8S 1Y2

[21] Appl. No.: 209,139

[22] Filed: Jun. 20, 1988

[51] Int. Cl.[4] ..... A47K 1/04

[52] U.S. Cl. ..... 248/129; 248/1 A; 248/125; 248/441.1; 248/676

[58] Field of Search ..... 248/1 A, 1 B, 125, 129, 248/148, 146, 441.1, 444.1, 646, 127, 676; 5/507; 108/49

[56] References Cited

U.S. PATENT DOCUMENTS

| | | | |
|---|---|---|---|
| 2,546,283 | 3/1951 | Webster | 248/444.1 X |
| 3,476,348 | 11/1969 | Rustand | 248/444.1 |
| 4,465,255 | 8/1984 | Hill | 248/444.1 |
| 4,511,111 | 4/1985 | Godfrey | 248/1 B X |
| 4,715,573 | 12/1987 | Liegel | 248/129 |

FOREIGN PATENT DOCUMENTS

| | | | |
|---|---|---|---|
| 0202442 | 10/1908 | Fed. Rep. of Germany | 5/507 |
| 0580991 | 8/1958 | Italy | 5/507 |

OTHER PUBLICATIONS

Work Stations that Work (T & A Diversified Products, Inc, date unknown).

*Primary Examiner*—Ramon O. Ramirez
*Attorney, Agent, or Firm*—Rogers, Bereskin & Parr

[57] ABSTRACT

A support device, for the monitor and keyboard of a personal computer, enables the personal computer to be used by a person lying on a bed. The support device has a support body adapted for mounting over a person on a bed. The support body has first and second shelves. Each shelf is inclined forwardly and downwardly towards the user, and the second shelf can be inclined at a greater angle. The monitor and keyboard are mounted on the first and second shelf respectively. Retaining members are provided for holding the monitor and keyboard on the shelves. The support body can be mounted on the bed itself, or on a base running on wheels beneath the bed.

24 Claims, 3 Drawing Sheets

SUPPORT DEVICE

FIELD OF THE INVENTION

This invention relates to a support device, for supporting a personal computer or the like, and more particularly relates to a support device for supporting the monitor and keyboard of a personal computer above a bed.

BACKGROUND OF THE INVENTION

At the present time, personal computers are being used for an increasing variety of tasks. They are frequently used for word processing tasks, for example. The current common configuration of a personal computer comprises a monitor and a separate keyboard. For use in a regular seated position, a variety of special items of furniture or support devices have been designed and built. Typically, such devices have separate shelves for the monitor and the keyboard, with in some cases provision for adjusting the height of the shelves independently. More elaborate devices include a variety of storage shelves and spaces above and below the monitor, which are dimensioned to accept certain standard items of auxiliary equipment, e.g. boxes containing diskettes, paper etc. One can obtain such devices designed specifically for office or commercial use, or alternatively designed for personal use in a home.

Whilst such devices are often well designed and work well for a healthy, seated person, they are totally unsuited for people suffering from a variety of ailments. In particular, one of the most common health problems is a bad back, which can be temporary or chronic. Back problems are extremely common, and frequently require the sufferer to spend some time lying prone. For example, in the case of a slipped disc, one often has to spend some time lying prone while the back recovers.

Whilst lying prone or on one's back, a person cannot operate a personal computer supported on a conventional support device, since both the monitor and the keyboard are at totally inappropriate angles. In many cases, particularly where a person is resting at home, it would be quite feasible for them to operate a personal computer, if only it could be provided at an appropriate orientation.

Accordingly, it is desirable to provide a support device for a personal computer, which can support both the monitor and the keyboard at a suitable orientation, so that they can be readily used by a person lying on their back.

In accordance with the present invention, there is provided a support device for a personal computer having a monitor and a separate keyboard, the support device comprising a support body adapted for mounting over a person lying on their back, a first shelf means, for a monitor, mounted on the support body and inclined forwardly and downwardly, a first retaining means for retaining a monitor on the first shelf means, a second shelf means, for a keyboard, in front of the first shelf means, and inclined forwardly and downwardly, and a second retaining means for retaining a keyboard on the second shelf means, whereby, with a monitor and a keyboard mounted and retained on the first and second shelf means respectively, a person lying on their back with the upper part of their body in front of the support device can use the monitor and the keyboard.

The support body can either be configured to be supported on a bed, or directly on a floor beneath the bed.

Preferably, the shelf and retaining means comprises, for each of the monitor and the keyboard, a shelf with a forward and upwardly extending lip or retaining member. The lip then serves to prevent the monitor or keyboard from sliding off the respective shelf. Additionally, particularly for the monitor, a means can be provided for tying or clamping the monitor in position.

Each of the shelves can be provided with means for adjusting its position relative to the support body. Thus, the first shelf can be provided with means for altering its angular adjustment only. The second shelf can then be mounted, so that it can be moved vertically and horizontally, and also angularly, so that each user can position it exactly as desired relative to the monitor.

For a better understanding of the present invention, and to show more clearly how it may be carried into effect, reference will now be made, by way of example, to the accompanying drawings, which show preferred embodiments of the present invention, and in which.

Figure 1:
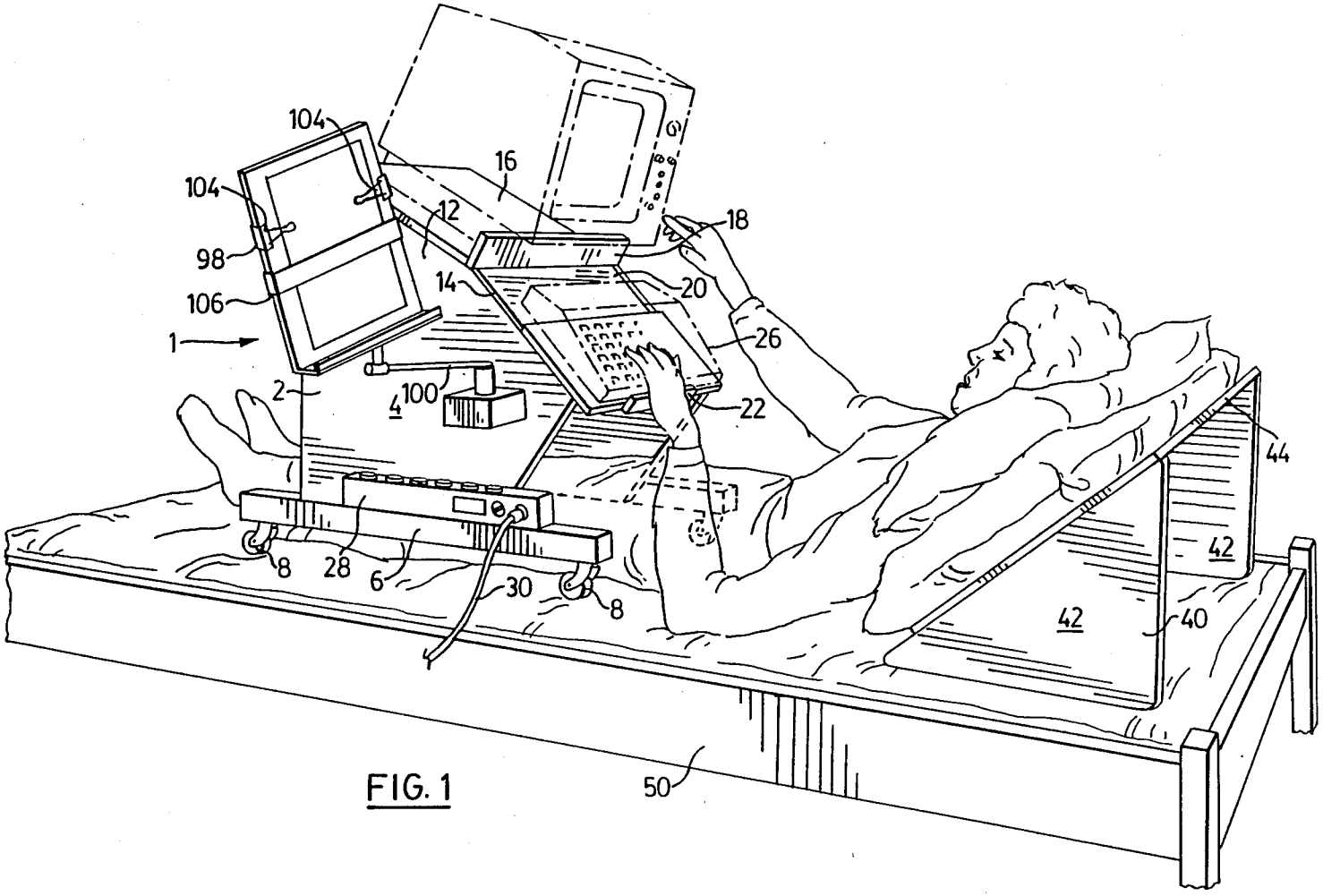
FIG. 1 is a perspective view of a first embodiment of a support device according to the present invention, on a bed in use.
Figure 2:
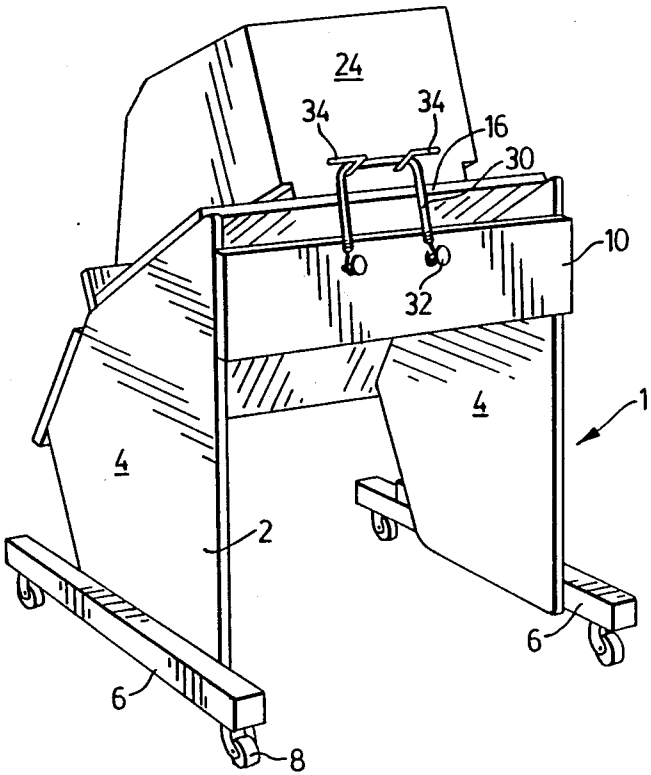
FIG. 2 is a perspective view from behind of the support device of the first embodiment.

The support device of FIGS. 1 and 2 is generally indicated by the reference numeral 1. The support device 1 includes a support body 2.

The support body 2 includes planar side members 4. Each side member 4 extends upwardly from a longitudinal element 6. Wheels 8, such as castor wheels are mounted on the longitudinal element 6. In the rear, the two side members 4 are joined by a transverse element 10.

The upper edge of each of the side members 4 is formed with a first straight portion 12 that is inclined forwardly and downwardly, and a second edge portion 14, which is also straight, the edge portion 14 is inclined forwardly and downwardly, but at a greater angle to the horizontal.

Mounted on the first edge portions 12 is a first shelf 16. At the forward edge of the first shelf 16, there is a first lip or retaining member 18. A second shelf 20 is mounted on the second edge portions 14, and a second lip or retaining member 22 is provided at the forward edge thereof. The first and second shelves 16, 20 are generally rectangular. The first retaining member 18 is also similarly rectangular and extends the full width of the support body 2. The second retaining member 22 is shorter than the retaining member 18 and only extends part way across the second shelf 20.

In use, as detailed below, a monitor 24 and a keyboard 26 can be placed on the first and second shelves 16, 20. The monitor and keyboard are shown in outline.

As shown in FIG. 2, a tiedown 30 is provided for securing the monitor 24 in position. The tiedown 30 cooperates with eyelets 32 screwed into the transverse element 10, and with hooks 34 on the back of the monitor 24. The hooks 34 are often provided for storing flex.

This tiedown 30 is provided, since the monitor 24 is relatively high, and if inclined at too great an angle may at least have a tendency to fall forwards onto the user. Thus, the monitor 24 is restrained from sliding forwards by the first retaining member 18 and held down on the first shelf 16 by the tiedown 30. For the keyboard 26, whilst this is inclined at a slightly greater angle, due to the shallow profile of the keyboard 26, this problem should not arise.

To provide a power supply for the monitor and keyboard 24, 26, a power supply strip 28 is mounted on the left hand longitudinal element 6. This power supply strip 28 has a cable 30, which would be connected to a standard electrical circuit, and on the top thereof a series of outlets, into which power supply leads for the monitor and keyboard can be plugged. The power supply strip 28 includes a control switch and a surge suppressor as well.

As shown in FIG. 1, the support device 1 of the present invention can be provided in combination with a head support 40. The head support 40 comprises two triangular side members 42, and a transverse support member 44.

A support device 1 and head support 40 are shown in use on a bed, indicated at 50. The bed 50 is of a standard twin width, i.e. 39 inches. The bed 50 is designed to be quite firm, so that the wheels 8 can readily run on it. For this purpose, it has a plywood base and a thin foam mat approximately 36 inches wide to give a modest amount of cushioning. The mat can be a futon or the like. The height of the top of the bed 50 is approximately 15 inches above the floor, to make it relatively easy for a person to sit up or lie down.

The support device 1 is positioned on the bed towards the foot of it. After a user has position him or herself on the bed, the support device is rolled along the bed over the user to a convenient position. The user's head and shoulders are supported by a number of pillows on the head support 40.

As shown, the monitor 24 and keyboard 26 are mounted on the shelves of the support device 1. Other associates components would be provided nearby. Thus, the diskette drives and a printer would be provided adjacent the bed on one side, for easy access by the user. Similarly, storage for diskettes, paper, files etc. would be provided, so that the diskette drive and printer can be readily used without the user having to leave the bed 50.

The support device 1 can be moved along the bed to give the appropriate distance between the user and the keyboard 26. Ideally, the support device 1 is positioned so that the user has his or her elbows resting on the bed 50, with the hands comfortably reaching the keyboard 26.

To enable independent adjustment of the eye to screen distance from the monitor 24, one of the first and second shelves 16, 18 can be made adjustable relative to the support device 1. Thus, one of the shelves can have supporting flanges that slide down inside the side members 4. Apertures can then be provided extending through the side members 4 and these support flanges, with a clamping device, e.g. a bolt and locking lever extending through each pair of apertures. Then, the appropriate shelf could be loosened and adjusted as desired, and then the locking levers operated to clamp it in position. Also, the other shelf could include means for adjusting only it angular orientation. This should enable both the monitor 24 and keyboard 26 to be adjusted to a preferred position.

The electrical connections to and from the support device 1 will likely require extra-long cables. In particular, connections from the computer to the keyboard, the printer and the monitor will likely need extra long cables. Also, the power supply connections from the power supply strip 28 to the main computer and also to the monitor 24 and keyboard 26 will often need extra-long cabling.

Additionally, there should be a separately switched power supply to lights, for background lighting, work lighting and keyboard lighting. Such switching is not shown.

Depending upon the work carried out, often the user will wish to have a text holder, for holding text adjacent the monitor 24. Conventional text holders assume that the text will be inclined at least slightly backwards, so as to be naturally retained by gravity. Here, the text holder will need to be positioned, beside the monitor, and inclined, so that the text is directed downwardly towards the user. It will thus be necessary to provide clips or other restraining elements for holding the text on it. The text holder could either be an extension to one side of the support device 1, or entirely free-standing.

FIG. 1 shows a text holder mounted to the side of one side member 4 of the support device 1. The text holder is generally indicated by the reference 98 and is supported by a support arm assembly 100. It includes clips 104 and/or a band 106 as a restraining element. This enables a text to be clipped to the text holder 98 and then oriented facing down towards the user, without the text falling off the holder.

Figure 6:
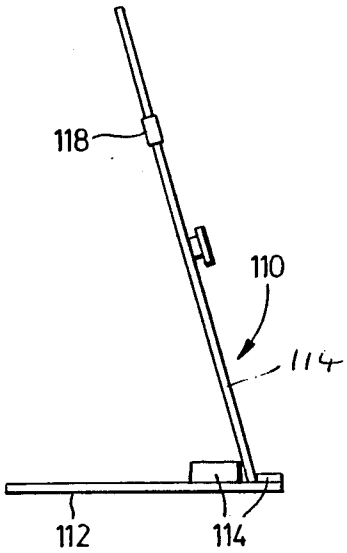
FIGS. 5 and 6 show perspective and side views of a free-standing text holder.
Figure 5:
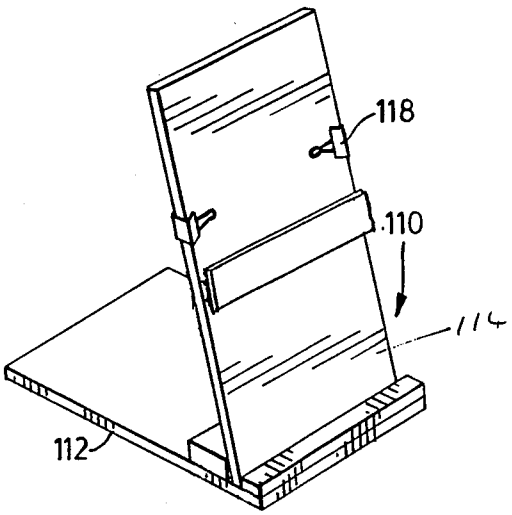

Alternately, a free-standing text holder can be provided, and an example of such a free-standing text holder is shown at 110 in FIGS. 5 and 6. The text holder 110 has a base 112 and an upright portion 114. Again, clips 118 or the like are provided for holding a text in position. The text holder 110 would be positioned to hold the text at a suitable height for the user.

Figures 3, 4:
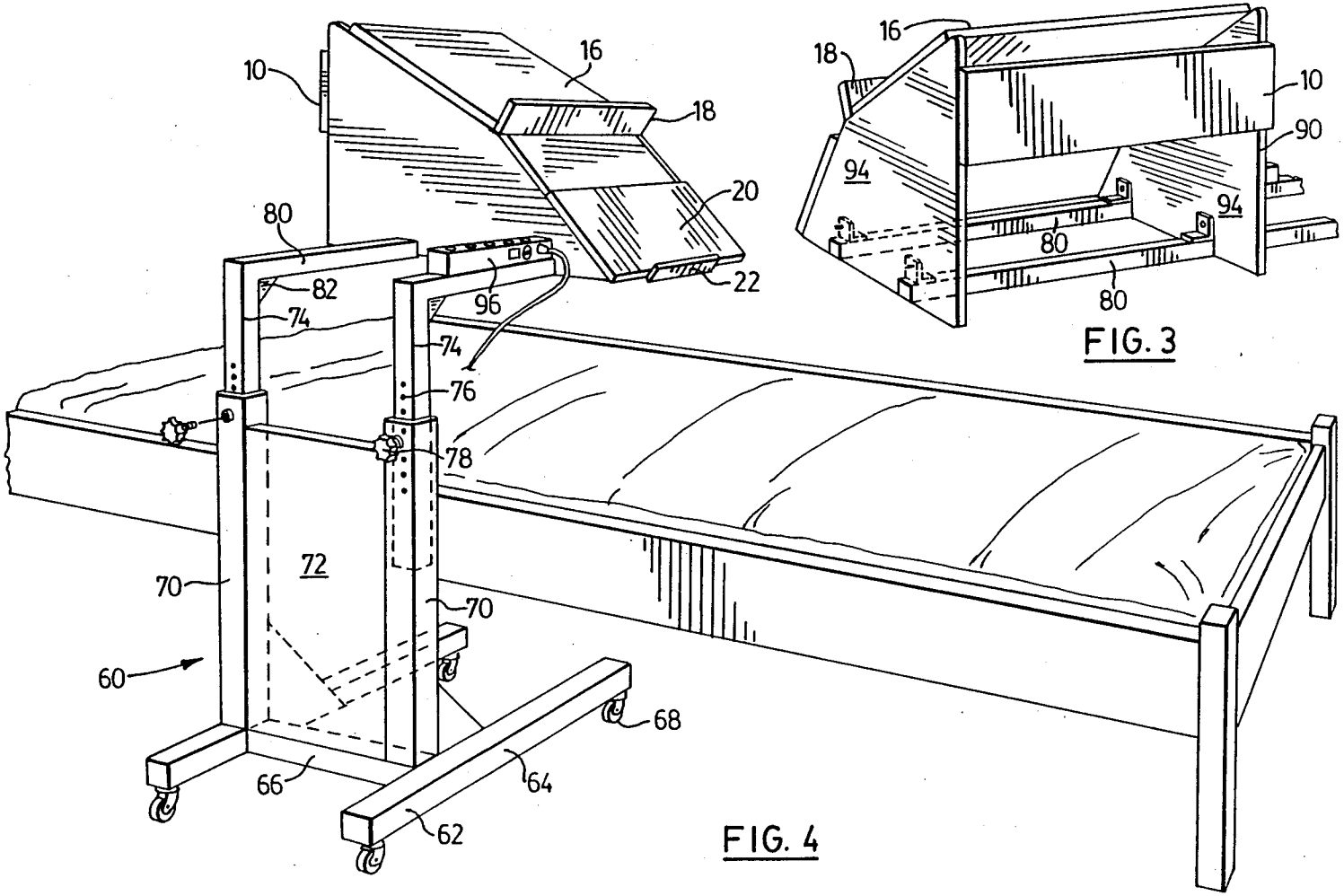
FIG. 3 is a perspective view from above and behind of part of a second embodiment of the present invention.
FIG. 4 is a perspective view, similar to FIG. 1, of a second embodiment of a support device.

The first embodiment of FIGS. 1–3 is intended to be formed primarily from wood. Reference will now be made to FIG. 4, which shows a second embodiment, which is intended to be free-standing on the floor. This second embodiment of the support device is designated by the reference 60. The support device 60 includes a base 62. The base 62 has an H-shape frame having transverse members 64 and a cross member 66. Castor wheels 68 are provided at the corners of the base 62. Upright members 70 extend from the base 62 and a sheet 72 extends between them.

The upright members 70 have a hollow square section. Legs 74 are slideably mounted in the upright members 70, and include rows of holes 76. At the top of each upright member 70, there is a threaded bore in which a threaded locking member with a knob 78 is mounted. The locking members 78 can thus be screwed in to engage selected holes 76 of the legs 74 to adjust the height of the legs 74.

For each leg 74 there is a support arm 80 extending out horizontally therefrom, with a reinforcing gusset 82 being provided.

All the elements of the support device 60 so far described are formed from steel and welded together in known manner. On the support arms 80, a support body 90 is provided, which can correspond with the upper part of the support body 2. Accordingly, like parts are given the same reference numeral for simplicity. The support body 90 has side members 94. The first and second shelves 16, 20, with the corresponding retaining members 18, 22 are provided extending between the side members 94. The side members 94 are strengthened by the transverse element 10.

A power supply strip 96, with a surge suppressor and control switch, is mounted on the forward support arm 80, in easy reach of the user.

In use, this second embodiment of the support device 60 would be used in much the same manner as the first embodiment. However, as it is now mounted on the floor, it should be easier to manoeuvre, and if desired, a softer padding can be provided for the user.

For the first embodiment, when the device is positioned over the user, the user can raise their knees beneath it. For this second embodiment, the arms 80 extending beneath the support body 90 will prevent this. However, the arms 80 and support body 90 could be modified to provide space for a user's knees.

I claim:

1. A support device for a personal computer having a monitor and a separate keyboard, the support device comprising a support body adapted for mounting over a person lying on their back, a first shelf means, for a monitor mounted on the support body and inclined forwardly and downwardly, a first retaining means for retaining a monitor on the first shelf means, a second shelf means for a keyboard, in front of the first shelf means, and inclined forwardly and downwardly, and a second retaining member for retaining a keyboard on the second shelf means, whereby, with a monitor and a keyboard mounted and retained on the first and second shelf means respectively, a person lying on their back with the upper part of their body in front of the support device can use the monitor and keyboard.

2. A support device as claimed in claimed in claim 1, wherein the second shelf means is inclined at a greater angle to the horizontal than the first shelf means.

3. A support device as claimed in claim 1, wherein at least one of the shelf means is adjustable relative to the support body to enable both shelf means to be set at desired locations relative to the user.

4. A support device as claimed in claims 1, 2 or 3, wherein the first retaining means includes tie down means, for securing a monitor on the first shelf means.

5. A support device as claimed in claim 4, wherein the first retaining means includes a retaining member which extends upwardly from a forward edge of the first shelf means and generally perpendicular thereto and the second retaining means comprising a second retaining member extending upwardly from a forward edge of the second shelf mean generally perpendicular thereto.

6. A support device as claimed in claim 1, which includes a power supply strip, having a plurality of outlets and a supply lead, mounted on the support body.

7. A support device as claimed in claim 6, wherein the power supply strip includes a switch.

8. A support device as claimed in claim 7, wherein the power supply strip includes a surge suppressor.

9. A support device as claimed in claim 8, wherein the second shelf means is inclined at a greater angle to the horizontal than the first shelf means, and wherein the first retaining means comprises a tiedown means for securing a rear of a monitor to a first shelf means and a first retaining member which extends upwardly from a forward edge of the first shelf means generally perpendicular thereto, and the second retaining means comprises a second retaining member which extends upwardly from a forward edge of the second shelf means generally perpendicular thereto.

10. A support device as claimed in claim 1, wherein the support body includes side members extending longitudinally beneath the first and second shelf means, to provide a space beneath the first and second shelf means for a user's knees.

11. A support device as claimed in claim 10, which includes a transverse element between the side members behind and below the first shelf means.

12. A support device as claimed in claim 11, wherein the first and second retaining means each comprises a respective first or second retaining member extending upwardly from a forward edge of the respective first or second shelf means and generally perpendicular thereto, and wherein the second shelf means is inclined at a greater angle to the horizontal than the first shelf means.

13. A support device as claimed in claim 12, wherein the first retaining means includes a tiedown means for securing the rear of a monitor to the first shelf means.

14. A support device as claimed in claim 10, wherein the lower edges of the side members are provided with wheels, for enabling the support body to travel longitudinally on a bed.

15. A support device as claimed in claim 11 or 13, wherein the lower edges of the side members are provided with wheels, to enable the support body to travel longitudinally along a bed.

16. A support device as claimed in claim 10, which includes a base, a plurality of wheels mounted on the base to enable the base to travel freely on a floor beneath a bed, and at least one upright member extending upwardly from the base and supporting the support body.

17. A support device as claimed in claim 16, which includes at least one leg supporting the support body and slidably mounted in a respective upright member, and which includes lockable adjusting means for enabling the vertical position of the leg and the support body to be adjusted and for locking the support body in position.

18. A support device as claimed in claim 17, wherein the lockable adjusting means includes, for each leg and respective upright member, a plurality of holes in at least one of the leg and the upright member and a locking member for insertion into the holes.

19. A support device as claimed in claim 17, which includes, for each upright member a support arm extending horizontally therefrom beneath the support body.

20. A support device as claimed in claim 19, which includes a transverse element extending between the side members behind and below the first shelf means.

21. A support device as claimed in claim 20, wherein the first and second retaining means comprises first and second retaining members, each of which extends upwardly from a forward edge of the respective first or second shelf means and generally perpendicular thereto, and wherein the second shelf means is at a greater angle to the horizontal than the first shelf means.

22. A support device as claimed in claim 21, wherein the first retaining means includes a tiedown means for securing a rear of a monitor to the first shelf means.

23. In combination, a support device as claimed in claim 1, 9, 14 or 16, and a head support device including a transverse member inclined at an angle to the horizontal.

24. In combination, a support device as claimed in claim 1, 9, 14 or 16, and a text holder mounted to the support body extending out to one side therefrom, the text holder including means for securely retaining a sheet thereon and being adapted to be inclined forwardly and downwardly towards a user.

* * * * *